US005458076A

United States Patent [19]

Loutrel et al.

[11] Patent Number: 5,458,076

[45] Date of Patent: Oct. 17, 1995

[54] SPREADER TIP WITH UNIVERSAL MOUNT

[75] Inventors: Stephen P. Loutrel, Carlisle, Mass.; Karl G. Sachs, Guilford, Conn.

[73] Assignee: Navtec, Inc., Guilford, Conn.

[21] Appl. No.: 254,959

[22] Filed: Jun. 7, 1994

[51] Int. Cl.[6] ..... B63H 9/04

[52] U.S. Cl. ..... 114/102

[58] Field of Search ..... 114/39.1, 39.2, 114/89, 90, 92, 94, 102, 108, 109, 111, 112, 113, 114, 115

[56] References Cited

U.S. PATENT DOCUMENTS 3,986,474 10/1976 King ..... 114/90

4,313,391 2/1982 Hall ..... 114/90

OTHER PUBLICATIONS

Nicro Fico, 1985 Catalog, 2065 West Avenue, 40th San Leandro, Calif. 94577, pp. 86–87.

*Primary Examiner*—Stephen Avila

*Attorney, Agent, or Firm*—St. Onge Steward Johnston & Reens

[57] ABSTRACT

A spreader tip is provided comprising a shroud receiving portion joined to a mount portion. The mount portion includes a tubular section of a size smaller than a hollow end of the spreader. The tubular section receives a connector to secure the tip to the spreader and to support the spreader along an axis. The mount portion also includes a web outwardly extending from the tubular section for supporting the spreader along a second axis, or includes a lip peripherally extending from the junction a distance sufficient to cap the hollow end of the spreader. Preferably, the tip includes both the web and the lip.

19 Claims, 3 Drawing Sheets

SPREADER TIP WITH UNIVERSAL MOUNT

FIELD OF THE INVENTION

The invention relates to tips for spreaders. More specifically, the invention relates to tip mounts which are universal for spreaders on port and starboard sides of a sailboat.

BACKGROUND OF THE INVENTION

Spreaders are arms connected to a sailboat mast at one end and used to guide, redirect and/or terminate standing rigging for the mast at the other end. By "standing rigging" is meant the fixed shrouds, strays and the like which hold the mast up and help control its bend side to side, and fore and aft.

Previously, tips were mounted within holes cut near an outboard end of spreaders. These tips were typically machined from solid bars of a noncorrosive metal such as aluminum. Machined tips were generally overbuilt, and thus heavy and expensive. More recently, extruded spreaders have been introduced and cast tips have been provided for mounting within the hollow outboard ends of the spreaders. The cast tips are generally lighter and less expensive than machined tips. Most recently, extruded spreaders have been provided shaped as aerodynamic foils to reduce wind drag.

A disadvantage of foil spreaders is that different tips are needed for mounting within the ends of the port and starboard spreaders due to their air foil shape and consequent shape of their hollow ends (see prior art FIG. 5). Thus, the manufacturing costs are doubled, as are inventory costs for retailers, and replacement costs for users. These disadvantages are exacerbated by the fact that a sailboat mast typically includes two, three, four, or more pairs of spreaders, each pair of which may be a different size and thus require a different tip.

What is desired therefore, is a spreader tip mountable within either the port or starboard side spreaders of a sailboat. A spreader tip adaptable to different size spreaders is also desired.

SUMMARY OF THE INVENTION

Accordingly, it is an object of the invention to provide a tip with a mount portion suitable for either the port or starboard side spreader on a sailboat.

Another object of the invention is to provide a spreader tip with a mount portion adaptable for different size spreaders.

A further object of the invention is to provide a spreader tip of the above character including a tubular section for receiving attachment means to secure the tip to the spreader.

Yet another object of the invention is to provide a spreader tip of the above character including a web portion adjustable to match the fore and aft width of the spreader.

Still another object of the invention is to provide a spreader tip of the above character including a lip for capping the hollow end of either a port or starboard side spreader.

These and other objects of the invention are achieved by provision of a spreader tip comprising a shroud receiving portion joined to a mount portion, the mount portion including a tubular section of a size smaller than a hollow end of the spreader, the tubular section for receiving a connector to secure the tip to the spreader and for supporting the spreader along an axis. The mount portion also includes a web outwardly extending from the tubular section for supporting the spreader along a second axis, or includes a lip peripherally extending from the junction a distance sufficient to cap the hollow end of the spreader. Preferably, the tip includes both the web and the lip.

Preferably, the tubular section has a rectangular cross section. Preferably, also, the spreader hollow is asymmetrical about a vertical axis. The lip preferably also caps a trailing edge of the spreader to reduce the risk of snagging a sail thereon. The web is preferably adaptable to different size spreaders.

The tip may also include a second web for supporting the spreader, most preferably along the second axis. The tip may also include a threaded cup mounted thereto for receiving a shroud end.

The invention and its particular features and advantages will become more apparent from the following detailed description considered with reference to the accompanying drawings.

DESCRIPTION OF THE INVENTION

A spreader tip 10 in accordance with the invention is illustrated in FIGS. 1–5. Spreader tip 10 comprises a shroud receiving portion 8 and a mount portion 9.

Figure 1:
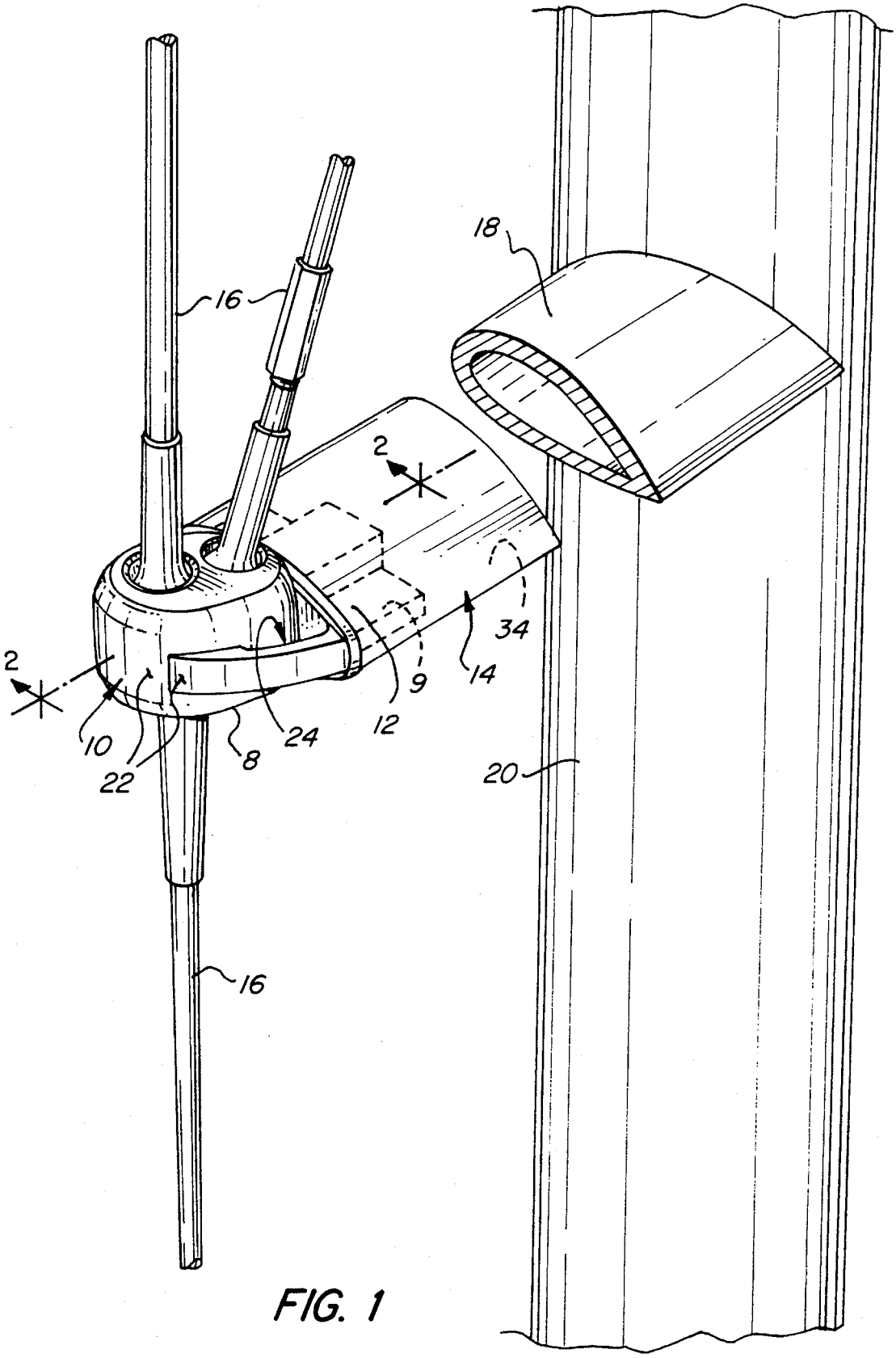
FIG. 1 is an isometric view of a spreader tip in accordance with the invention shown mounted within the end of a spreader connected to a sailboat mast.

FIG. 1 depicts spreader tip 10 mounted by mount portion 9 (not shown in this Figure) to an end 12 of spreader 14 and also depicts a plurality of shrouds, stays or the like 16 received into shroud receiving portion 8. Tip 10 may be machined, but is preferably cast in order to provide a rounded outer surface 22 unlikely to snag a sail (not shown) and also to provide cut out portions 24 which advantageously reduce the weight of tip 10 without significant additional expense, and without significantly weakening the tip. It is understood that low tip weight reduces weight aloft which is important to performance of a sailboat in a seaway due to the distance such weight lies from the center of mass of the sailboat and the consequent force generated by such weight as the sailboat heels or rocks.

Figure 2:
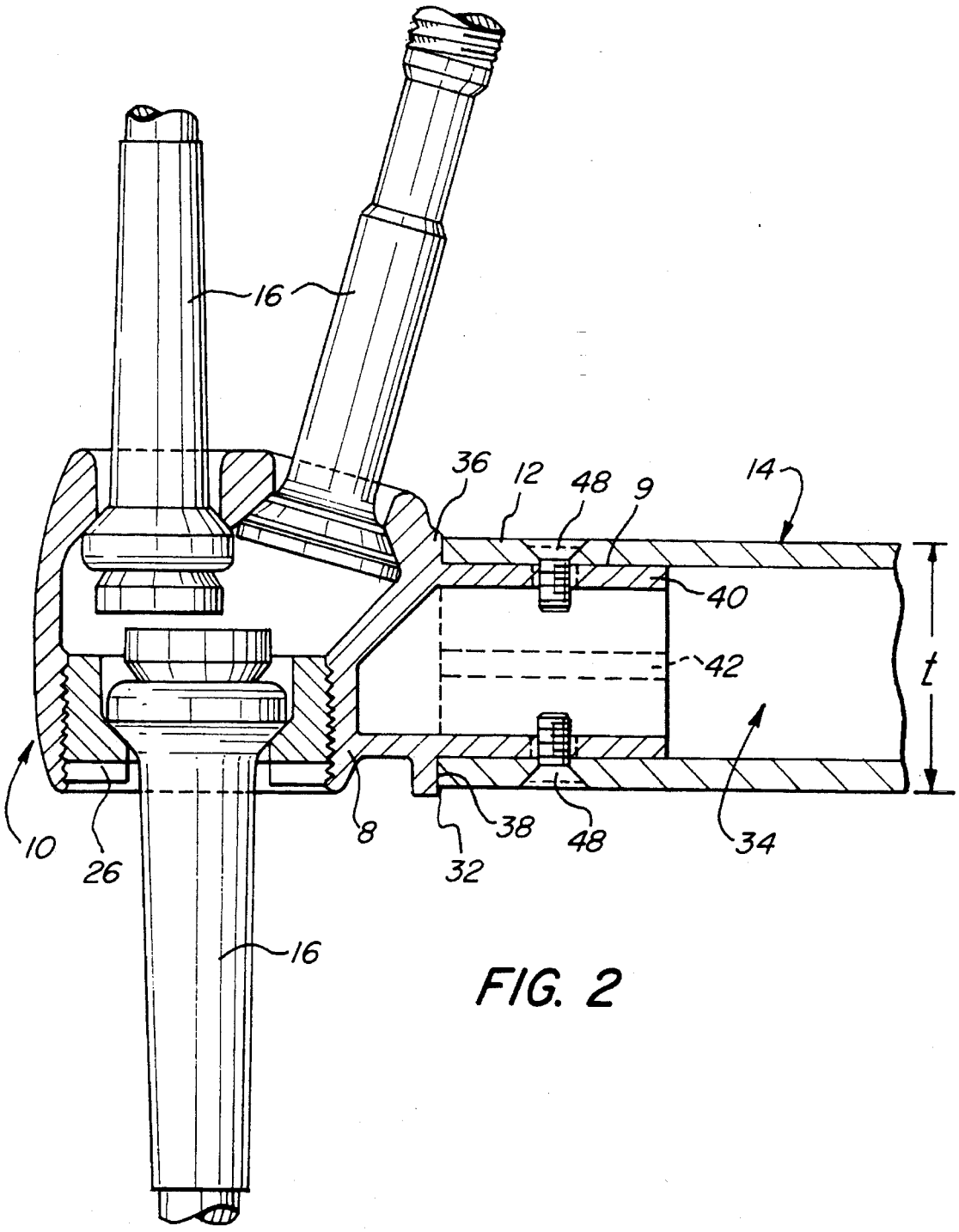
FIG. 2 is a front cross-sectional view taken along the plane 2—2 in FIG. 1 of the spreader tip of FIG. 1, depicting the tip mount within the end of the spreader and the connection of stays or shrouds to the tip.

As illustrated in FIG. 2, shrouds 16 terminate within shroud receiving portion 8 of tip 10, however, it is understood that tip 10 may also simply guide or direct shrouds passing therethrough. A threaded cup 26 is provided for termination, in a known manner, of the last shroud received by and connected to tip 10.

Spreader 14 is mounted at another end 18 to a mast 20 of a sailboat (not shown). Shrouds 16 function to hold mast 20 erect on the sailboat and also to control its bend both fore and aft, and side to side. In this regard, spreaders 14 function to space shrouds 16 apart from mast 20 in order that the shrouds may apply forces to the mast in the proper direction.

Figure 3:
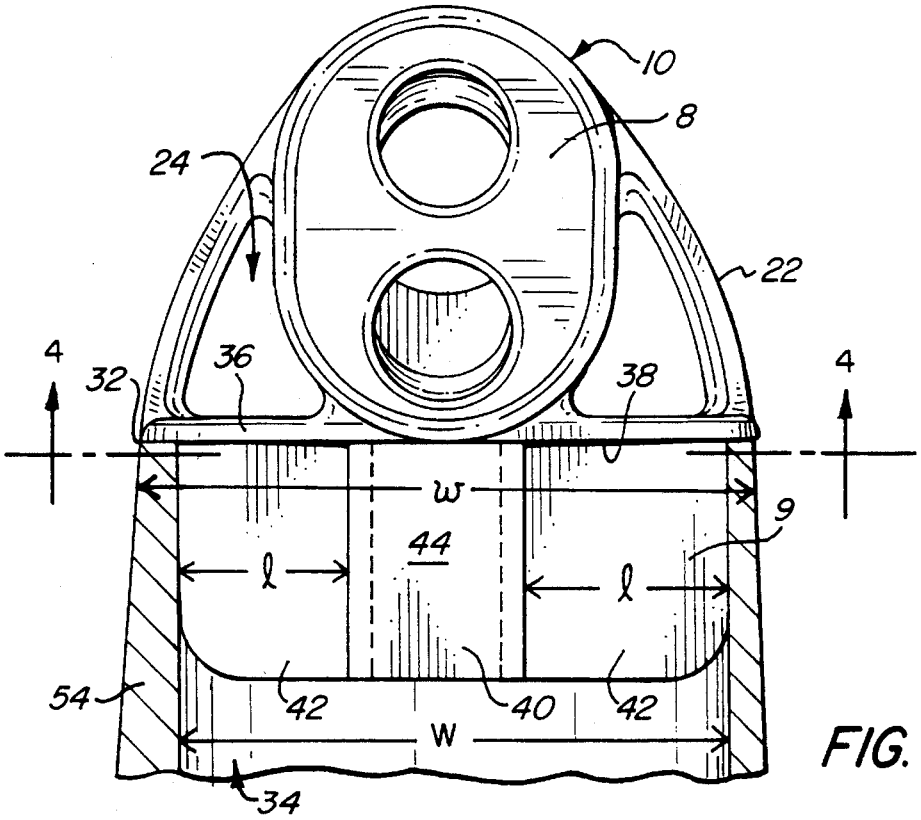
FIG. 3 is a top plan view of the spreader tip of FIG. 1 with the shrouds/stays removed and the spreader cut away to reveal the tip mount.

Referring now to FIGS. 2 and 3, shroud receiving portion 8 is joined to a mount portion 9 at a junction 32. Mount portion 30 is utilized to mount tip 10 within a hollow 34 at end 12 of spreader 14. Although it is not necessary, hollow 34 extends throughout the length of spreaders 14 since they are typically formed by extrusion.

A lip or flange 36 peripherally extends from junction 32 a distance sufficient for a face 38 of lip 36 to cover or cap hollow end 34 of spreader 14 at its point of maximum thickness t and across its entire outer width w. Lip 36 also covers the corner 40 at the end of trailing edge 52 of spreader 14 which might otherwise snag and damage a sail (see FIG. 4).

Figure 4:
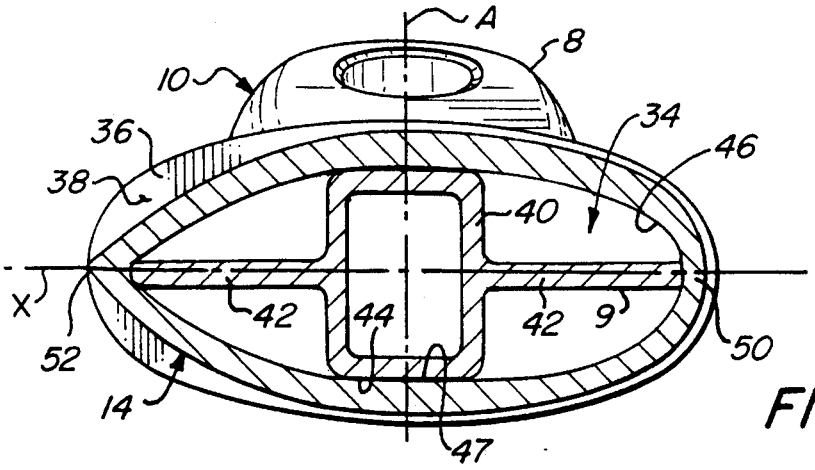
FIG. 4 is a side cross-sectional view taken along the pane 4—4 in FIG. 3 of the spreader tip of FIG. 1, depicting the tubular and web portions of the mount.

Referring now to FIGS. 3 and 4, the design and function of mount 9 is illustrated. Mount 9 comprises a tubular section 40 and outwardly extending webs 42. Tubular section 40 is smaller than hollow 34 such that there is not continuous mating contact between an outer surface 44 of tubular section 40 and the entire inner surface 46 of spreader 14. Tubular section 40 does contact portions 47 of hollow inner surface 46 with its outer surfaces 44 and thereby supports spreader 14 along an axis A (see FIG. 4). Axis A is preferably a top to bottom asymmetrical axis through the thickest portion of spreader 14, although other axes may also be used.

The tubular construction of section 40 permits it to receive a connector or fastener 48 (see FIG. 2), such as a rivet or screw, for securing tip 10 to spreader 14 without substantially degrading the structural integrity or spreader support function of mount 9. It is understood that once the sail boat rig is loaded, tip 10 is pressed and retained against spreader end 12 by shrouds 16. Further, tubular section 40 is designed to fit within the hollow of, and thus to mount tip 10 to, either a port or starboard spreader. This is achieved by positioning tubular section 40 on mount 9 so that its surfaces 44 contact hollow inner surface portions 47 which are similarly positioned and similarly spaced apart on both the port and starboard side spreaders. It is understood, in this regard, that spreaders 14 have an aerodynamic foil shaped cross section (see FIG. 4) comprising a bulbous forward end or nose 50 and a tapered rear or trailing edge 52 on both the port and starboard sides to promote laminar flow and thus reduce turbulent wind resistance. Typically, spreaders are formed by extrusion and thus in order to reduce their weight to provide performance advantages in a seaway, the hollows also have a substantially aerodynamic foil shaped cross section (see FIG. 4) reducing spreader wall thickness to near a minimum necessary to provide structural integrity.

Figure 5:
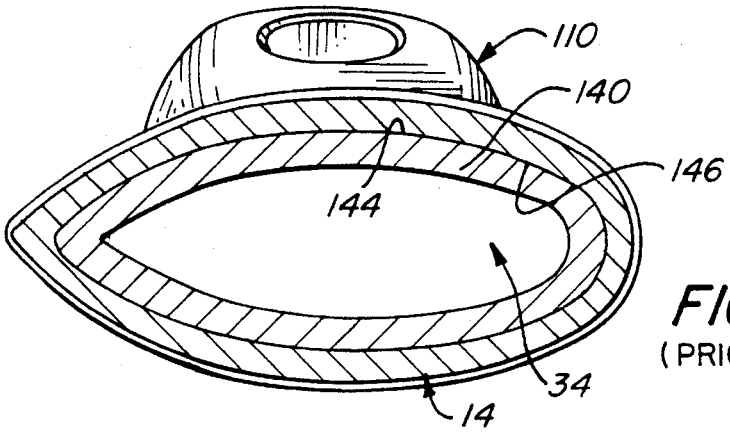
FIG. 5 (PRIOR ART)
FIG. 5 is a side cross-sectional view similar to FIG. 4 but of a prior art spreader tip mount which matches the entire contour of the hollow within the end of the spreader in surface mating contact.

Interchangeability from port to starboard spreaders is not possible with prior art tips 110 such as are illustrated in FIG. 5 because tubular section 140 has an outer surface 144 which continuously mates with the entire inner surface 146 of hollow 34. This is disadvantageous because it increases the cost of tips 110 and means that an additional part must be inventoried by retailers and stored by sailors for emergency repairs. Tubular section 40 on tip 10 of the invention achieves interchangeability by having a smaller cross section than hollow 34 and by having an outer surface 44 positioned to contact hollow inner surface portions 47 which are similarly positioned and spaced apart on both starboard and port side spreaders.

Although illustrated with a rectangular cross section, it is understood that tubular section 40 may also be provided with a round or other cross-sectional shape as desired or as necessitated by factors such as ease of forming, ease of securement to spreader 14, shape of the spreader hollow, and the like.

Webs 42 extend outwardly from tubular section 40 of mount 9 to support spreader 14 along another axis X. It is understood that although two webs are illustrated, only a single web may be necessary to support spreader 14 along axis X. In this regard a second and additional webs may also be used to support spreader 14 along a third and additional axes if necessary or desired.

Preferably, axis X is an axis of symmetry which passes through spreader 14 fore and aft from bulbous nose 50 to tapered, trailing edge 52. In this regard, one of webs 42 extends between tubular portion 40 and inner surface 46 of hollow 34 opposite trailing edge 52 and the other web 42 extends between tubular portion 40 and inner surface 46 of hollow 34 opposite bulbous nose 50 whether mount 9 is inserted to hollow 34 of a port or a starboard side spreader 14. Most preferably axes A and X are perpendicular.

Length 1 of webs 42 is easily changed to permit use of mount 9 for attachment of tips 10 to spreaders having various hollow widths W (see FIG. 3). For example, additional lengths of material may be welded to the webs or the webs may be cut down as necessary. Changing web length advantageously does not alter the structural rigidity of tubular section 40 of mount 9. It is understood that due to the method of manufacturing spreaders 14, mounts 9 may also be utilized for attachment of tips 10 to spreaders having various outer widths at their ends which outer widths may taper down from end 18 at which they are attached to mast 20 toward end 12. This taper must be achieved without altering hollow width W if spreaders 14 are to be formed by extrusion, and is therefore achieved by extruding spreaders with a solid tab 54 (see FIG. 3) which is then worked after extrusion to provide the desired taper toward end 12, and also the taper toward trailing edge 52.

Typically, different size spreaders will have different size hollow portions so that tip 10 may advantageously be used with the differently sized spreaders which are commonly used on the same sailboat. As with port and starboard side interchangeability, the ability to use tip 10 on different size spreaders reduces the cost of tips 10, and means that fewer parts need be inventoried by retailers and stored by sailors for emergency repairs.

Although the invention has been described with reference to a particular arrangement of parts, materials of construction, features and the like, these are not intended to exhaust all possible arrangements, materials or features, and indeed many other modifications and variations will be ascertainable to those of skill in the art.

What is claimed is:

1. A spreader tip for a spreader comprising:

a shroud receiving portion for receiving shrouds; and a mount portion, joined to said shroud receiving portion, for mounting within a hollow end of the spreader;

said mount portion including a tubular section of a size smaller than the hollow end of the spreader, said tubular section for supporting the spreader along a first axis, and for receiving a connector to secure the tip to the spreader, a web extending outwardly from said tubular section for supporting the spreader along a second axis, said web adaptable to support different size spreaders without reducing the structural integrity of said tubular section, and a lip peripherally extending from the junction of said shroud receiving and mount portions a distance sufficient to cap the hollow end of the spreader.

2. The spreader tip of claim 1 wherein said tubular section has a rectangular cross section.

3. The spreader tip of claim 1 including a second web extending outwardly from said tubular section for supporting the spreader, said second web adaptable to support different size spreaders without reducing the structural integrity of said tubular section.

4. The spreader tip of claim 3 wherein said second web supports the spreader along the second axis.

5. The spreader tip of claim 1 wherein said lip caps a trailing edge of the spreader to reduce the risk of snagging a sail thereon.

6. The spreader tip of claim 1 wherein the spreader hollow is asymmetrical about a vertical axis.

7. The spreader tip of claim 1 wherein said shroud receiving portion includes a threaded cup removably mounted thereto for receiving a shroud end.

8. In a spreader tip for a spreader including a shroud receiving portion for receiving shrouds, and a mount portion joined to said shroud receiving portion for mounting within a hollow end of the spreader, the improvement comprising wherein said mount portion includes:

a tubular section of a size smaller than the hollow end of the spreader, said tubular section for supporting the spreader along a first axis, and for receiving a connector to secure the tip to the spreader; and a web extending outwardly from said tubular section for supporting the spreader along a second axis, said web adaptable to support different size spreaders.

9. The spreader tip of claim 8 including a lip peripherally extending from the junction of said shroud receiving and mount portions a distance sufficient to cap the hollow end of the spreader.

10. The spreader tip of claim 8 wherein said tubular section has a rectangular cross section.

11. The spreader tip of claim 8 including a second web extending outwardly from said tubular section for supporting the spreader, said second web adaptable to support different size spreaders without reducing the structural integrity of said tubular section.

12. The spreader tip of claim 11 wherein said second web supports the spreader along the second axis.

13. The spreader tip of claim 8 wherein the spreader hollow is asymmetrical about a vertical axis.

14. The spreader tip of claim 8 wherein said shroud receiving portion includes a threaded cup removably mounted thereto for receiving a shroud end.

15. In a tip for a spreader including a shroud receiving portion for receiving shrouds, and a mount portion joined to said shroud receiving portion for mounting within a hollow end of the spreader, the improvement comprising wherein said mount portion includes:

a tubular section of a size smaller than the hollow end of the spreader, said tubular section for supporting the spreader along a first axis, and for receiving a connector to secure the tip to the spreader; and a lip peripherally extending from the junction of said shroud receiving and mount portions a distance sufficient to cap the hollow end of the spreader, and wherein said shroud receiving portion includes a threaded cup removably mounted thereto for receiving a shroud end.

16. The tip of claim 15 including a web extending outwardly from said tubular section for supporting the spreader along a second axis, said web adaptable to support different size spreaders.

17. The tip of claim 15 wherein said tubular section has a rectangular cross section.

18. The tip of claim 15 wherein said lip caps a trailing edge of the spreader to reduce the risk of snagging a sail thereon.

19. The tip of claim 15 wherein the spreader hollow is asymmetrical about a vertical axis.

* * * * *